US005325806A

United States Patent [19]

Lee

[11] Patent Number: 5,325,806

[45] Date of Patent: Jul. 5, 1994

[54] SEAT FOR INFLATABLE VESSELS

[76] Inventor: Rodney S. Lee, 1708 Academy Dr., Melbourne, Fla. 32901

[21] Appl. No.: 990,091

[22] Filed: Dec. 14, 1992

[51] Int. Cl.[5] ..... B63B 7/08

[52] U.S. Cl. ..... 114/345; 114/347; 114/363

[58] Field of Search ..... 114/345, 363, 347

[56] References Cited

U.S. PATENT DOCUMENTS

| | | | |
|---|---|---|---|
| 1,419,464 | 6/1922 | Meyer | 114/345 |
| 1,701,684 | 2/1929 | Lee | 114/363 X |
| 2,522,910 | 9/1950 | Wayne | 9/2 |
| 2,971,568 | 2/1961 | Rovie | 155/45 |
| 3,099,482 | 7/1963 | Woodruff | 297/193 |
| 3,839,757 | 10/1974 | Grimes | 9/7 |
| 3,935,607 | 2/1976 | Cantwell | 9/2 |
| 4,428,617 | 1/1984 | Lawson | 114/363 X |
| 4,729,336 | 3/1988 | Rohne | 114/363 |
| 4,771,722 | 9/1988 | Tihany | 114/345 |
| 4,854,261 | 8/1989 | Goldsmith | 114/343 |
| 5,101,753 | 4/1992 | Hull | 114/345 |

FOREIGN PATENT DOCUMENTS

| | | | |
|---|---|---|---|
| 3511042 | 10/1986 | Fed. Rep. of Germany | 114/363 |

*Primary Examiner*—Sherman Basinger

*Attorney, Agent, or Firm*—Frank L. Kubler

[57] ABSTRACT

A seat for use in an inflatable vessel having a vessel floor includes a support structure to place on the vessel floor for supporting a person in a seated position, and a member extending from the support structure for more widely distributing the weight of the structure and the person. The member is preferably an elongate member fitting through openings in the support structure. The support structure is preferably a box including a top surface, and front and rear wall portions joined by side wall portions. Two openings are preferably provided in the front wall portion and two corresponding openings in the rear wall portion and two members for distributing weight are provided and are fitted through the corresponding openings. The members are preferably PVC tubes. The seat preferably includes a back rest portion attached to and protruding generally upward from the support structure. The back rest portion preferably has a lower end and is hingedly connected to the support structure at the lower end so that the back rest portion can pivot down against the support structure during seat transport and storage. At least one tubular holder is preferably attached to the back rest portion and has an end protruding generally upward for receiving and holding a fishing rod handle. A cushion is preferably provided on the top wall of the box.

7 Claims, 3 Drawing Sheets

SEAT FOR INFLATABLE VESSELS

BACKGROUND OF THE INVENTION

1. Field of the Invention

The present invention relates generally to the field of accessories for inflatable water vessels having vessel floors such as inflatable canoes, rafts and kayaks, and more specifically to a seat for placing on the floor of such a vessel, the seat including a cushion on top of a box portion which has a door and serves as a storage compartment, and which has holes in the lower corners of its front and rear walls and two parallel pipe sections which are fit through these holes when preparing the seat for use, for distributing the weight of the seat and seat occupant over a wide area of the vessel floor, to prevent the seat from bowing the floor downward and distorting the shape of the vessel, and which are slid out of the holes when preparing the seat for storage, the seat additionally including a back rest panel and soft tubular cushion members attached to the panel front face, the panel lower edge being joined to the box with hinges to pivot against the top of the box when the seat is to be stored, the back rest panel preferably including semicircular tubular members attached to the panel rear face with ends directed upward for receiving the handle of at least one fishing rod.

2. Description of the Prior Art

There have long been seats in inflatable boats, canoes and kayaks. These seats have generally been permanently attached to the rest of the boat during manufacture so that repositioning or removal is not possible. Conventional chairs and stools are not well suited to this use because they distribute weight over a small area, and thus can bow, distort or actually puncture the floor of the craft.

Hull, U.S. Pat. No. 5,101,753, issued on Apr. 7, 1992, teaches an attachable seat for an inflatable boat. Cross-members deliver the weight of the seat and compartment primarily onto the sides rather than the floor of the boat. A vertical brace member extends to the floor of the boat, but fails to distribute the load over the floor, and is intended to rest on a wooden deck. Thus, this structure is not well suited to soft bottom rafts and canoes. The fishing rod holders are merely half rings, and would not support and hold a rod securely.

Goldsmith, U.S. Pat. No. 4,854,261, issued on Aug. 8, 1989, discloses a boat seat including cushions resting on a box. The bottom of the box itself presents the surface area to distribute the load, but this area appears insufficient for the weight of the seat and occupant for use on a soft bottom boat. Adding to this weight are a sink, a water supply tank and a cooler contained within the box.

Cantwell, U.S. Pat. No. 3,935,607, issued on Feb. 3, 1976, reveals an inflatable boat having inflated tubular walls and a bottom portion. The Cantwell seats rest on the tubular walls rather than on the bottom, and all that the text states about the seats is that they may be attached in a suitable manner to side sections. They do not appear to be removable or otherwise transferable.

Grimes, U.S. Pat. No. 3,839,757, issued on Oct. 8, 1974, discloses a fishing boat seat assembly including a box having on each side two hinged support rods supporting a seat. The seat can swing upward on the rods and toward the rear of a boat for fishing, and then downward and toward the front of the boat for other uses. The box defines a lower compartment for dry storage and an upper compartment for use as a depth finder housing. The seat swings above the top compartment to reach the fishing position. The problem presented by Goldsmith is again presented. The bottom edges of the box do not sufficiently spread the weight of the seat and occupant for use on a soft bottom boat.

Woodruff, U.S. Pat. No. 3,099,482, issued on Jul. 30, 1963 and Rorie, U.S. Pat. No. 2,971,568, issued on Feb. 14, 1961, once again disclose seats having heavy box base members intended for use on hard bottom boats. And, once again, the weight distribution appears inadequate for use on soft bottom boats.

Wayne, U.S. Pat. No. 2,522,910, issued on Sep. 19, 1950, teaches a collapsible boat having a series of ribs connected by an upper rim and lower belts and having a rigid, folding keel. The Wayne seats fit over the rigid keel and use the keel for support. A problem with Wayne is that the keel is a preexisting part of the boat not found on inflatable vessels, and the seats themselves provide no effective weight distribution.

It is thus an object of the present invention to provide a removable, transferrable seat for an inflatable vessel which distributes the weight of the seat and occupant widely over the floor of the vessel to minimize vessel deformation.

It is another object of the present invention to provide such a seat which includes secure fishing rod holders.

It is still another object of the present invention to provide such a seat which includes a storage compartment for fishing implements and food items.

It is finally an object of the present invention to provide such a seat which is simple in design and inexpensive to manufacture.

SUMMARY OF THE INVENTION

The present invention accomplishes the above-stated objectives, as well as others, as may be determined by a fair reading and interpretation of the entire specification.

A seat is provided for use in an inflatable vessel having a vessel floor, including a support structure to place on the vessel floor for supporting a person in a seated position, and a member extending from the support structure for more widely distributing the weight of the structure and the person. The member is preferably an elongate member fitting through openings in the support structure. The support structure is preferably a box including a top surface, and front and rear wall portions joined by side wall portions. An opening is preferably provided in the front wall portion and a corresponding opening in the rear wall portion and the member for distributing weight passes through the openings and extends to the front of and to the rear of the box. Two openings are preferably provided in the front wall portion and two corresponding openings in the rear wall portion and two members for distributing weight are provided and are fitted through the corresponding openings. The members are preferably PVC tubes. The seat preferably includes a back rest portion attached to and protruding generally upward from the support structure. The back rest portion preferably has a lower end and is hingedly connected to the support structure at the lower end so that the back rest portion can pivot down against the support structure during seat transport and storage. At least one tubular holder is preferably attached to the back rest portion and has an end protruding generally upward for receiving and holding a fishing rod handle. A cushion is preferably provided on the top wall of the box.

A seat is also provided for use in an inflatable vessel having a vessel floor, including a support structure to place on the vessel floor for supporting a person in a seated position, a back rest portion attached to and protruding generally upward from the support structure, wherein the back rest portion has a lower end and is hingedly connected to the support structure at the lower end so that the back rest portion can pivot down against the support structure during seat transport and storage.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
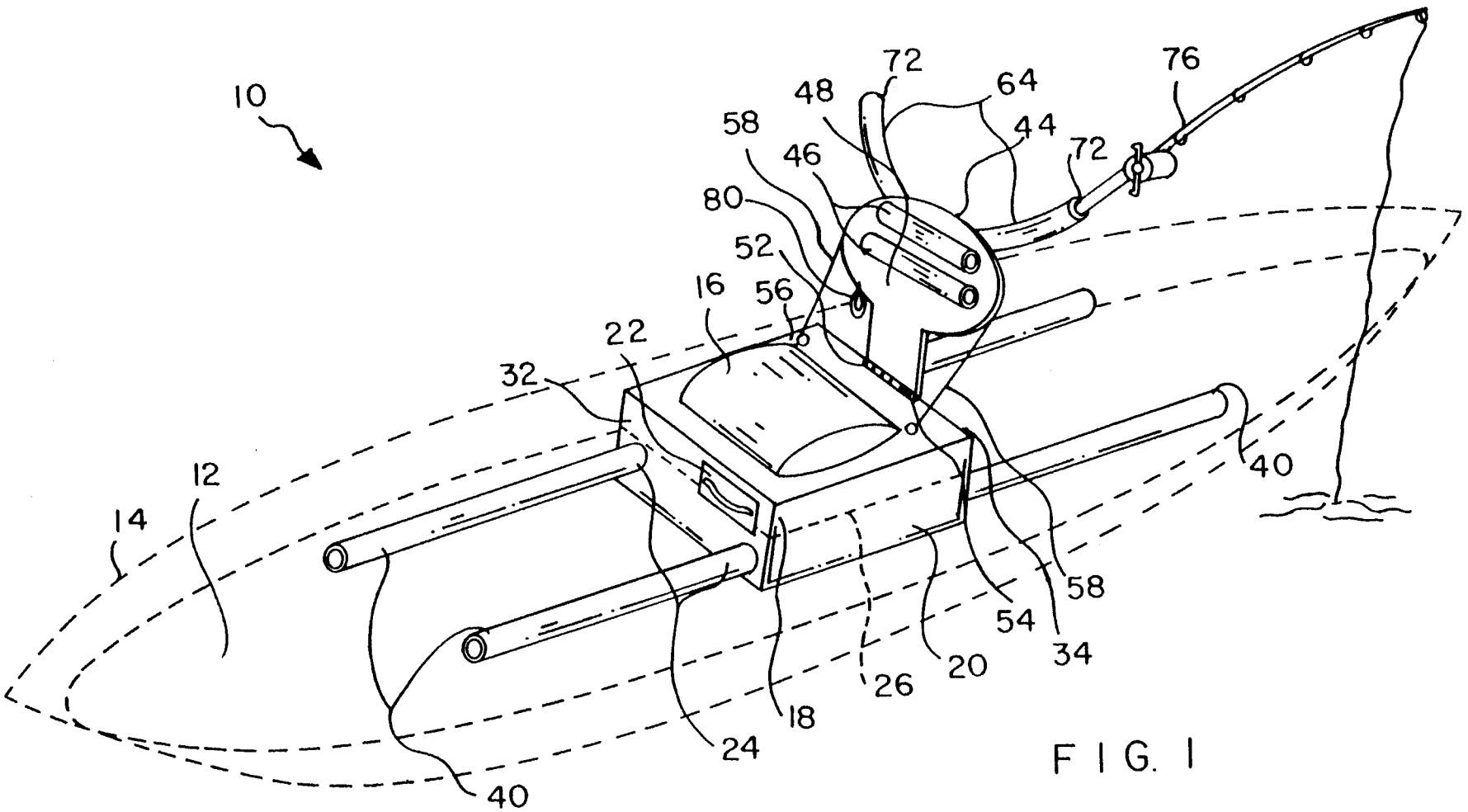
FIG. 1 is a front perspective view of the inventive boat seat positioned for use within an inflatable vessel.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

FIRST PREFERRED EMBODIMENT

Referring to FIG. 1, a seat 10 is disclosed for placing on the floor 12 of an inflatable vessel 14, such as an inflatable canoe, raft or kayak. Seat 10 preferably includes a cushion 16 on top of a box portion 20. Alternatively, box portion 20 may be a yielding lattice or mesh construction to itself act as a cushion. Box portion 20 has a door 22 and contains a storage compartment 18, which is optionally insulated for cold storage. A removable panel 26 preferably forms the bottom of storage compartment 18. Box portion 20 has ports 24 in the lower corners of its front wall 32 and its rear wall 34. Two parallel PVC pipe sections 40 fit through ports 24 and extend to the front and to the rear of box portion 20, to widely distribute the combined weight of box portion 20 and a seat occupant. Pipe sections 40 thereby prevent seat 10 from bowing floor 12 downward and distorting the shape of vessel 14. Pipe sections 40 are preferably cut to almost the full length of the floor 12 of a specific vessel 14. When seat 10 is to be transported or stored, pipe sections 40 are slid out of ports 24.

Figure 2:
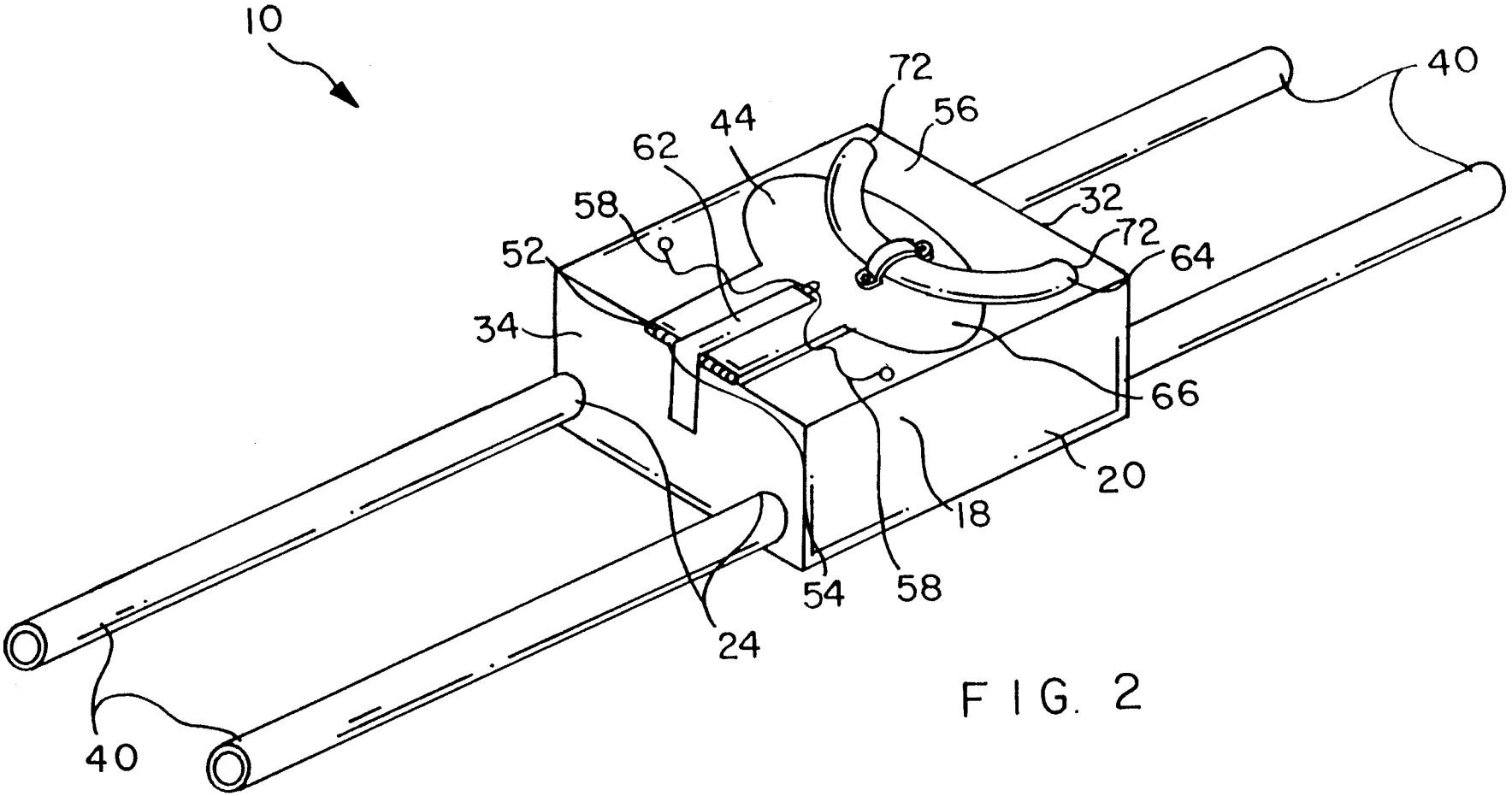
FIG. 2 is a rear perspective view of the inventive boat seat alone with the hinged back rest lowered for transport and storage.
Figure 3:
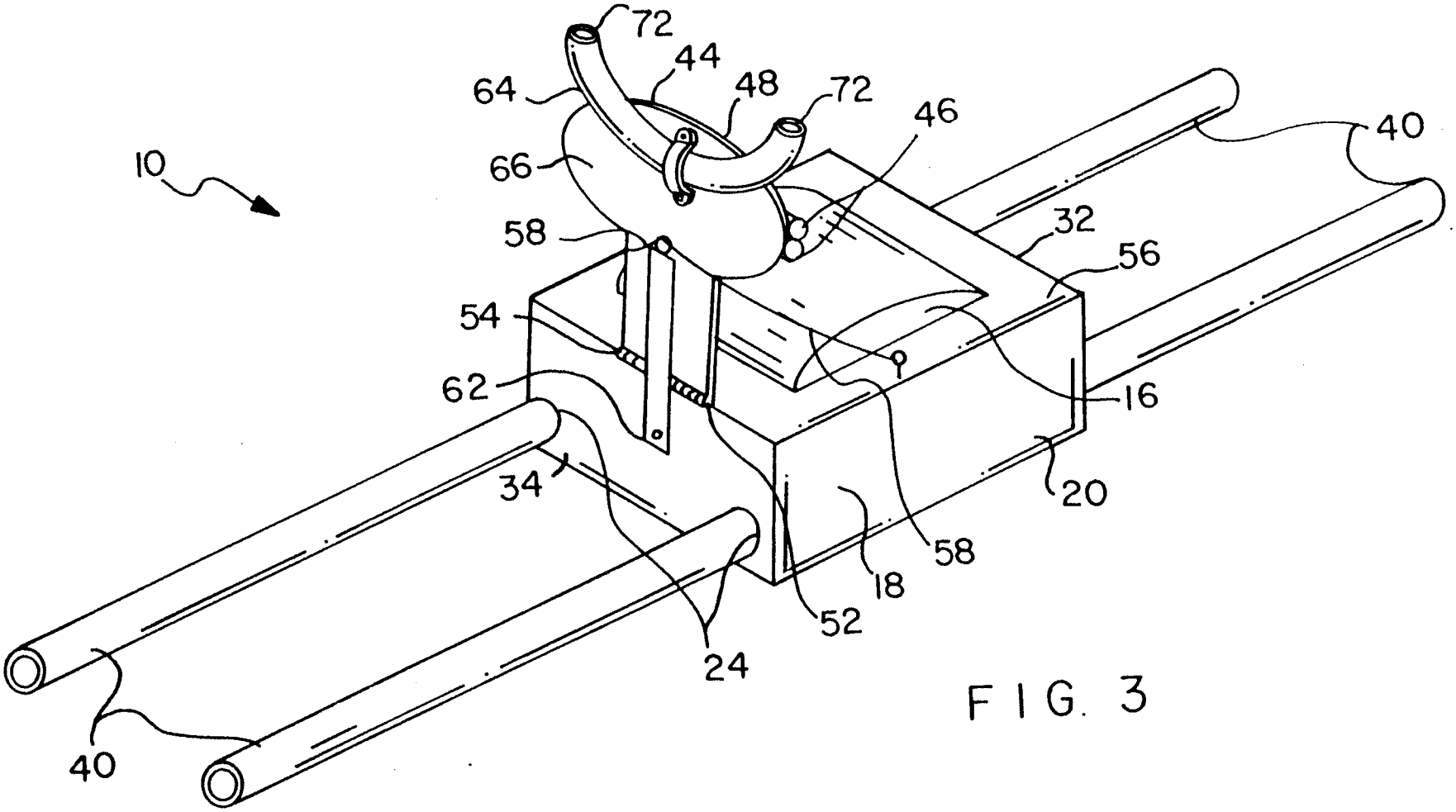
FIG. 3 is a rear perspective view as in FIG. 2, except that the hinged back rest is raised.

Seat 10 preferably includes a back rest panel 44 having soft tubular cushion members 46 attached to panel 44 front face 48. Panel lower edge 52 is joined to box portion 20 with hinges 54 to pivot against the top wall 56 of box portion 20 when seat 10 is to be stored. See FIG. 2. Adjustable cable members 58 limit the extent to which back rest panel 44 tilts back. An elastic member 62 is preferably removably attached at one end to panel 44 and at the other end to top wall 56, to bias panel 44 in an upright position against cable members 58. Arc-shaped tubular members 64 are preferably removably bolted to the rear face 66 of panel 44, so that the member ends 72 are directed upward for receiving the handle of at least one fishing rod 76. See FIG. 3. A utility hook or spring clasp 80 is preferably attached to panel 44. Elastic member 62 is in this instance attached at one end to panel 44 and removably attached at the other end to top wall 56 with a hook.

Two seats 10 may be combined by sliding two box portions 20 over a single pair of pipe sections 40, one box portion 20 in front of the other box portion 20. For such an arrangement, box portions 20 are preferably strapped or hooked together.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A vessel and seat apparatus, comprising:

an inflatable vessel having a flexible vessel floor, a support structure placed on said vessel floor for supporting a person in a seated position, wherein said support structure comprises a top surface, and front and rear wall portions, an elongate member extending from said support structure having a surface substantially parallel to and abutting said vessel floor substantially along the entire length of said elongate member for more widely distributing the weight of said structure and said person over said vessel floor, an opening being provided in said front wall portion and a corresponding opening being provided in said rear wall portion and said member for distributing weight passing through said openings and extending to the front of and to the rear of said support structure.

2. An apparatus as in claim 1, wherein two openings are provided in said front wall portion and two corresponding openings are provided in said rear wall portion and two said members for distributing weight are provided and are fitted through said corresponding openings.

3. An apparatus as in claim 1, wherein said member is a PVC tube.

4. An apparatus as in claim 1, additionally comprising a back rest portion attached to and protruding generally upward from said support structure.

5. An apparatus as in claim 4, wherein said back rest portion has a lower end and is hingedly connected to said support structure at said lower end so that said back rest portion can pivot down against said support structure during seat transport and storage.

6. An apparatus as in claim 4, wherein at least one tubular holder is attached to said back rest portion and has an end protruding generally upward for receiving and holding a fishing rod handle.

7. An apparatus as in claim 1, wherein a cushion is provided on said top surface of said support structure.

* * * * *